US005644885A

United States Patent [19]

Eischeid

[11] Patent Number: 5,644,885

[45] Date of Patent: Jul. 8, 1997

[54] MOUNTING FOR FACING PANELS

[76] Inventor: Karl Eischeid, Schulweg 23, D-51766 Engelskirchen, Germany

[21] Appl. No.: 557,186

[22] PCT Filed: Jun. 8, 1994

[86] PCT No.: PCT/DE94/00632

§ 371 Date: Dec. 5, 1995

§ 102(e) Date: Dec. 5, 1995

[87] PCT Pub. No.: WO95/00728

PCT Pub. Date: Jan. 5, 1995

[30] Foreign Application Priority Data

Jun. 23, 1993 [DE] Germany ..... 9309306 U
Oct. 12, 1993 [DE] Germany ..... 9315386 U

[51] Int. Cl.[6] ..... E04F 13/14; E04B 2/88

[52] U.S. Cl. ..... 52/513; 52/235; 52/506.08; 52/508; 52/512; 52/597; 52/698; 52/713; 248/220.22; 248/221.11; 248/301

[58] Field of Search ..... 52/235, 597, 702, 52/508, 512, 513, 283, 698, 713, 506.06, 506.08; 248/220.21, 220.22, 221.11, 223.31, 301, 305, 316.2

[56] References Cited

U.S. PATENT DOCUMENTS

| | | | |
|---|---|---|---|
| 2,293,743 | 8/1942 | Miles et al. | 52/597 X |
| 2,633,735 | 4/1953 | Dondero | 52/698 X |
| 3,224,715 | 12/1965 | Maggiore | 248/301 X |
| 3,450,427 | 6/1969 | Fischer | 52/513 |
| 3,715,850 | 2/1973 | Chambers | 52/235 X |
| 3,903,670 | 9/1975 | Robinson, Jr. | 52/713 X |
| 5,419,091 | 5/1995 | Roberts | 52/513 X |

FOREIGN PATENT DOCUMENTS

| | | | |
|---|---|---|---|
| 1048729 | 2/1979 | Canada | 52/713 |
| 2540160 | 8/1984 | France . | |
| 1813030 | 6/1970 | Germany | 52/235 |
| 1916590 | 11/1970 | Germany . | |
| 3127873 | 2/1983 | Germany | 52/235 |
| 3143791 | 5/1983 | Germany | 52/235 |
| 3503406 | 8/1986 | Germany | 52/235 |
| 3721452 | 1/1989 | Germany | 52/698 |
| 3737081A1 | 5/1989 | Germany . | |
| 581758 | 10/1946 | United Kingdom | 52/513 |

*Primary Examiner*—Carl D. Friedman
*Assistant Examiner*—Laura S. Saladino

[57] ABSTRACT

Mounting (10) for facing panels, which have several securing bolts (12) projecting on the wall side with panel-parallel securing collars (13), behind which engages at least one wall anchor (15) which is anchored to the wall with anchor bolts (16).

In order to fasten the facing panel to the wall with simple means and in a simple way, the mounting is designed so that the securing bolts (12) are suspended with their panel-parallel securing collars (13) in at least one hook-like wall anchor (15), which prior to the mounting of the facing panel (11) to the wall is detachably connected with the securing bolt (12).

17 Claims, 9 Drawing Sheets

FIG 8.b

MOUNTING FOR FACING PANELS

Figure 1A:
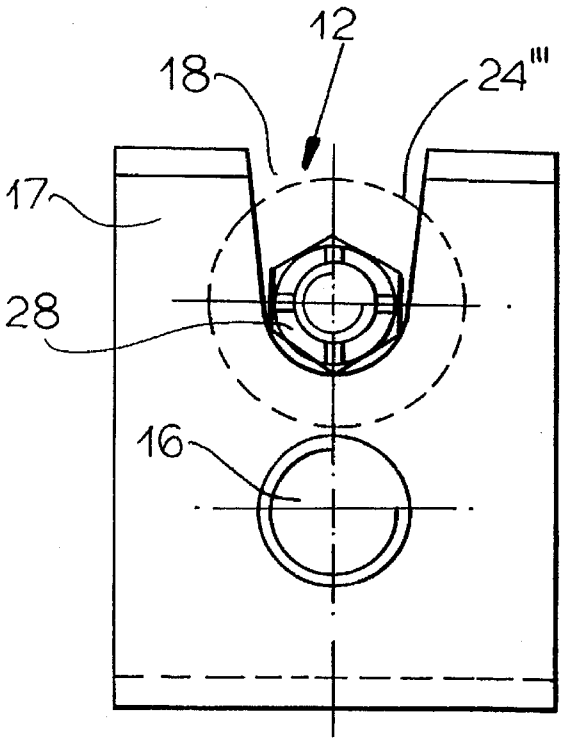

The invention relates to a mounting for facing panels which has several securing bolts projecting on the wall side with securing collars running parallelly to the panel, behind which engages at least one wall anchor secured to the wall by anchor bolts and receiving the securing bolts in a suspension slot, whereby a detachable auxiliary mounting means is provided.

A mounting for facing panels which on the wall side have several projecting securing bolts with panel-parallel securing collars, behind which engages at least one hook-like wall anchor which can be anchored in the wall with an anchor bolt is known from DE 37 37 081 A1. The known securing bolt is connected to the facing panel in an axially form-locking manner and has on the wall side a threaded nut forming the securing collar which is parallel to the panel. Behind this securing collar, respectively the known nut, engages a wall anchor which is designed like a frame structure secured to the wall with fastening screws. This connection of the wall anchor with the facing panels, respectively their securing bolts is difficult to handle due to the variety of the required individual adjustments and the multitude of parts. Problems arise particularly in the positioning and the formation of connection points at the wall on the one hand and at the facing side on the other hand.

From DE-A-1 916 590 it is known to screw together light concrete panels and mounting bars via securing bolts and to provide the mounting bars with wall anchors which are inserted in large pear-shaped and undercut anchor holes provided in the wall, wherein plaster is filled in order to securely mount the light concrete panels. The wall anchors are bolts which are fastened by nuts on the mounting bars, which are screwed on the rear of the panel via spacing pieces. Therefore the mounting is built of many parts and expensive to produce. The positioning of the light concrete panels can be critical, since one has to wait for the plaster to harden. The assembly effort with the known mounting is correspondingly high.

From the FR-A-2 540 160 a mounting with the features mentioned in the introduction is known. The facing panel is of a large format and correspondingly heavy. Therefore it is lifted by a lifting machine into a position wherein lower securing bolts of the facing panel are positioned in suspension slots of anchor bolts. In order to secure the upper edge of the facing panel for its fastening to the wall, a wall-side metallic bracket is inserted which prevents the facing panel from tilting away from the wall until upper securing bolts are screwed into the facing panel and secure the latter against tilting. Then the metallic bracket is removed. The known metallic bracket is basically an auxiliary mounting means. It can be dispensed with when the mechanical connection taking place in the normal manner between the wall anchor and the securing bolt can be performed quickly enough. As a result the known metallic bracket complicates the mounting of the facing panel.

By contrast it is the object of the invention to improve a mounting of the aforementioned kind so that facing panels can be fastened to the wall with simple means and in a simple manner.

This problem is solved due to the fact that as an auxiliary mounting means a spring element is provided between the securing bolt and the wall anchor, which pulls the wall anchor towards the securing bolt and which is fastened to a panel edge.

It is important for the invention that it moves away from a screwed connection of the facing panel with an understructure, namely by means of wall anchors. Rather hook-like wall anchors are provided, wherein the securing bolts are suspended with their panel-parallel securing collars. Accordingly the assembly of the facing panel with the wall anchors is extremely simple. A threaded connection is not required. Correspondingly the mounting expenses are drastically reduced. The bores in the facing panels required for the durable connection between the facing panels and the wall anchors and the separate parts to be used as securing bolts can be industrially manufactured and easily inserted on site.

The fact that the wall anchors and the securing bolts always have the same relative position to each other is of particular importance for the assembly of the facing panel with the wall by means of the wall anchors. Only then can it be insured that the anchor bolts of all wall anchors are correctly inserted in the wall bores, which have been prepared according to the distribution diagram of the securing bolts over the facing panel. In order to achieve for the anchor bolt of the wall anchor the same distribution pattern established for the securing bolts, the mounting is built so that prior to the mounting of the panel a durable connection between the securing bolts of a panel and its pertaining wall anchors is created. The releasable connection of both construction components makes it possible, after the insertion of the securing bolts into the wall, respectively after the fastening of the anchor bolt in the wall, e.g. with a cementable anchor, to remove the panel again, in order to control the whether the anchor bolts are embedded sufficiently deep in the wall and in the adhesive. Subsequently the facing panels can be easily suspended again with the securing collars of their securing bolts in the wall anchor, whereby the wall bore filled with a cementing mass secures the anchor bolt by means of a nondetachable adherence, so that the desired position of the facing panel in relation to the wall can not be changed.

In view of the releasable connection between the securing bolts and their wall anchors, the mounting is built so that for the releasable connection between the securing bolt with the wall anchor a spring element is provided, which pulls the wall anchor towards the securing bolt and is fastened to a panel edge. The spring element causes the securing bolt and the wall anchor to cramp, so that both together with the facing panel form a construction unit. On the other hand the spring element can be removed without further ado, due to its releasable fastening to the panel edge, so that a release of the connection between the securing bolt and the wall anchor takes place, for instance after the wall anchor was set in position on site. By detaching the spring element affixed to the panel edge it becomes possible to simply remove this auxiliary assembly means from the gap between the facing panel and the wall, so that there is more space e.g. for the heat insulation which is mounted after the removal of the facing plate and after the correct set of the anchor bolts in the wall was inspected.

In order to create a simple detachable connection between the securing bolt and the wall anchor by means of the spring element, the mounting is built so that the spring element engages the wall anchor from behind with a dimensionally stable hook and with a further dimensionally stable hook it engages the panel edge from behind. The dimensionally stable hooks allow a secure engagement at the wall anchor, respectively at the panel edge with a simultaneous free selection of the design of the spring element between these two hooks. A secure fit is insured.

Advantageously the mounting is built so that the hook engaging the wall anchor at its rear is a plate with a bent up lower border for a plate-shaped anchor hook with a slanted lower border. In such a configuration the hook engaging the wall anchor can be simply made of sheet metal which is manufactured by simple means and which is sufficiently durable for a great number of uses of the auxiliary assembly means.

For similar reasons the mounting can also be built so that the hook engaging the panel edge at its rear is a metal sheet plate with an edge encompassing the panel edge. The aforedescribed hooks have on the one hand to take into account the configuration of the securing bolt and of the wall anchor, but on the other hand they also have to take into account that on the rear of the facing panel there is a multitude of mounting, respectively securing bolts and wall anchors. In view of this the mounting is designed so that the hook engaging the wall anchor at its rear has an open slot in the area of one hook edge, so that it can encircle the anchor bolt and the securing collar with play and/or that the hook engaging the panel edge at its rear has a recess for encircling a mounting close to the panel edge. The open slot can be stamped out without further ado during the manufacturing of the hook, whereby the play has to be calculated so that the hook can be set without prolonged testing. When designing the hook which engages the panel edge at its rear it can be taken into account that two securing bolts will align and that the auxiliary assembly means of the one securing bolt will have to be placed in, respectively over the area of the other securing bolt. The therefrom arising difficulties are avoided due to the recess in the hook engaging the panel edge at its rear.

It is necessary to build the mounting in such a manner that the hooks engaging the wall anchor, respectively panel edge, at its rear be provided with fastening elements for the spring elements, so that a multitude of loose separate parts for a single securing spot, respectively a single securing bolt, can be avoided.

It is particularly advantageous when the mounting is built so that the spring element is a perforated rubber band, which is buttoned with each of its holes over at least one fastening element designed as a snap-in projection of one of the engaging hooks. The perforated rubber band can be manufactured at the same time with the snap-in projections of the hooks without any problems. This construction assembly is reliable and not unintentionally detachable. On the other hand the perforated rubber band can be easily unbuttoned again, for instance when it is very worn out or torn at one end, or when another length has to be set when with the same auxiliary mounting means a facing panel of another size has to be placed.

In order to make the mounting as flat as possible it is designed so that the securing bolt has a socket arranged in the panel with a projecting annular collar, as well as a socket-locking screw with a head radially surpassing the annular collar and forming the panel-parallel securing collar and that the annular collar of the socket is suspended in a suspension slot of a panel-parallel anchor bolt. As a result the securing bolt is a two-part construction component, whose socket-locking screw has to functions, namely on the one hand to secure the position of the socket in the facing panel in the selected spread position and on the other hand to insure the connection with the wall anchor, by building the panel-parallel securing collar in such a way that the anchor hook of the wall anchor can engage at its rear. Between the securing collar of the securing bolt and the facing panel there has to be only a comparatively narrow space or gap defined by the thickness of the annular collar of the socket, whereinto the anchor bolt can be slid so that its suspension slot surrounds the annular collar of the socket. Since the plate of the auxiliary assembly means which engages the wall anchor at its rear is also flat, as is also the spring element designed for instance as a perforated rubber band, none of the mounting parts project far in the direction of the anchor bolt, so that the gap between the rear of the facing panel and the wall can be narrow, respectively in the space remaining between the auxiliary assembly means and the wall there is sufficient room available for the manipulations required during the removal of the auxiliary assembly means.

The mounting can be advantageously developed so that the anchor bolt be provided at its end close to the wall with an elastic cover plate for covering the pertaining wall bore longitudinally slidable along the bolt at the moment of its insertion in the bore. The elastic cover plate allows for the excess cement to be squeezed out of the wall bore, but also prevents an unintended running out of the cement.

A further development of the mounting consists in that the anchor bolt is provided with a holding plate for an insulation layer, which is transversely attachable after a heat insulation layer has been introduced between the wall and the facing panel. As a result it is possible at least to reduce the number of various, holding elements of the heat-insulating layer to be used outside the area of the anchor bolt.

The mounting can further be perfected due to the fact that over the upper panel edge of a facing panel fastened to the wall at least one auxiliary assembly rail projecting on the visible side of the facing is releasably interlocked, whose holding hook, after the mounting of a further facing panel, can be pulled out by being rotated by 90° from the gap between two facing panels. The auxiliary assembly rail makes possible to slide towards the wall a facing panel built together with wall anchors, guided at its lower edge with the anchor bolt up front, whereby the anchor bolts of the wall anchors engage correctly into the wall bores, thereby reducing the load exerted on the facing panel via its securing bolts due to tilting of the facing panel. Correspondingly the auxiliary mounting means holding together the securing bolts and the wall anchors are also relieved of load. Since the holding hook can be adjusted to the gap width, it is possible to remove the auxiliary assembly rail without problems.

A further specialization of the mounting results when the holding hook with the auxiliary assembly rail is thread-adjustably connected transversely to the panel and can be fastened in its screwed-in position with an arresting screw. A mounting, respectively an auxiliary assembly rail with such a holding hook makes possible to use the auxiliary assembly rail also for various panel thicknesses.

In particular it is possible to build the mounting in such a way that the auxiliary mounting rail is can be removed after bracing means have been introduced next to it in the gap between the two facing panels. The early removal of an auxiliary assembly rail makes possible the use of the rail in a different location, even then when the fastening of the anchor bolt in a wall bore is not yet finalized. During this time the support means insure sufficiently the position of the facing panel.

Advantageously the mounting is designed so that the wall anchor has an anchor bolt parallel to the securing bolt, and its end on the panel side has a panel-parallel anchor hook. The anchor bolt is built so that the wall anchor can be suitably anchored in the wall. The configuration of the anchor bolt can be left to each individual case of use. Thereby the panel-side end of the anchor bolt is provided with nevertheless with a panel-parallel anchor hook, which facilitates the suspension of the facing panels, respectively of the securing bolts of these facing panels.

The mounting is preferably designed so that the panel-parallel anchor hook consists of a flat plate which is welded to a anchor bolt designed as threaded bolt. The flat plate forming the anchor hook can be manufactured in a simple manner by stamping and its welding to the anchor bolt can be done without any problem by machine. Since the anchor bolt is designed as a threaded bolt it can be used without further ado in a socket on the wall side, however its is preferable to design it as a cementable anchor, in which case a wall bore filled with a cementing mass receives the threaded bolt, whereby an undetachable cementing of the threaded bolt into the wall takes place.

Advantageously the mounting is built so that the panel-parallel anchor hook has a vertical suspension slot open at the top, whose suspension length is bigger than the width of the junction gap between two facing plates. For a durable mounting of the facing panels a simple suspension slot in the wall anchor is sufficient. The suspension length is selected so that a facing panel in a plate joint can not be unintentionally removed from the pertaining suspension slot of the wall anchors, namely it is bigger than the width of the junction gap between two facing panels. On the other hand it is not easily possible to replace a facing panel, in that the further facing panels located above this facing panel are raised only as much as to make the suspension slots accessible to the securing bolts of the facing panel to be replaced.

When the panel-parallel anchor hook has several mutually parallel suspension slots, one for each of the securing bolts, it is possible to fasten the facing panel to the wall with fewer wall anchors. In the case of a wall anchor affixed into the wall secured against rotation one such wall anchor is sufficient, which with its mutually parallel suspension slots receives a corresponding number of securing bolts, thereby securing the facing panel in several spots.

The position of the panel-parallel anchor hooks of the wall anchor on the securing bolt, respectively relative to the facing panel is determined by the fact that, between its head and its thread, the screw locking the socket has a spacing collar which in the built-in position rests directly or via an annular collar against the socket, the width of this spacing collar being slightly bigger than the plate thickness of the anchor hook. As a result of the slight axial play caused by the spacing collar the socket-locking screw can be easily suspended with its spacing collar in the suspension slot of the anchor hook. The spacing collar insures that the head of the socket-locking screw always maintains the necessary distance from the socket to accommodate the anchor hook.

In order to insure that the wall anchor has always the desired axially parallel position with a socket-parallel securing bolt, the mounting is designed so that the anchor hook is provided on the panel side with spacing projections, whose projection is approximately equal to the thickness of the annular collar of the socket and/or the socket-locking screw.

Advantageously the mounting is designed so that a U-shaped spring-loaded holding clamp is available, which serves for holding together a wall anchor with a facing panel prior to the fastening of the facing panel to the wall, by clamping one arm over the securing bolt and another arm under the wall anchor. The two arms of the holding clamp press the securing bolt and the wall anchor against each other, whereby the placing of the socket-locking screw into the base of the suspension slot and thereby as close as possible to the anchor bolt is insured.

In order to make the holding clamp as stable as possible, the latter is built so that the holding clamp has lodging recesses and/or an insertion stop on the arm edges facing each other.

A further possibility to connect the holding clamp and the wall anchor as stably as possible in a preselected relative position is to build the mounting so that for holding together a wall anchor and a facing panel prior to the fastening of the facing panel to the wall, on the head of the socket-locking screw a clamping element is slid over and/or fastened, which clamps over the anchor bolt and locks it. The fastening of the clamping element on the socket-locking screw can be built corresponding to the strength requirements of the connection, for instance as a press fit, while the locking takes place exclusively on the anchor bolt. This is also a very material-saving construction.

It can be advantageous when the holding clamp or the clamping element is provided with a handle over the length of the panel and/or with spacing projections. With the handle extending over the panel length it is possible to remove the holding clamp as soon as the connection of the wall anchor with the wall is sufficiently strong. This is the case during cementing, when the cement is sufficiently hardened. By removing the holding clamps these can be repeatedly used and it is therefore not necessary to use one holding clamp for each connection spot of the facing panel. The spacing projections serve for an improved alignment of the holding clamp or the clamping element between the facing panel and the wall parallel to both.

Inasmuch as the assembly of the wall anchor with the securing bolt has to be achieved without play, the mounting is designed so that the hook and/or the securing collar have a conical or the like clamping spring which bridges the play, thus eliminating suspension play transversely to the facing panel.

Figure 1:
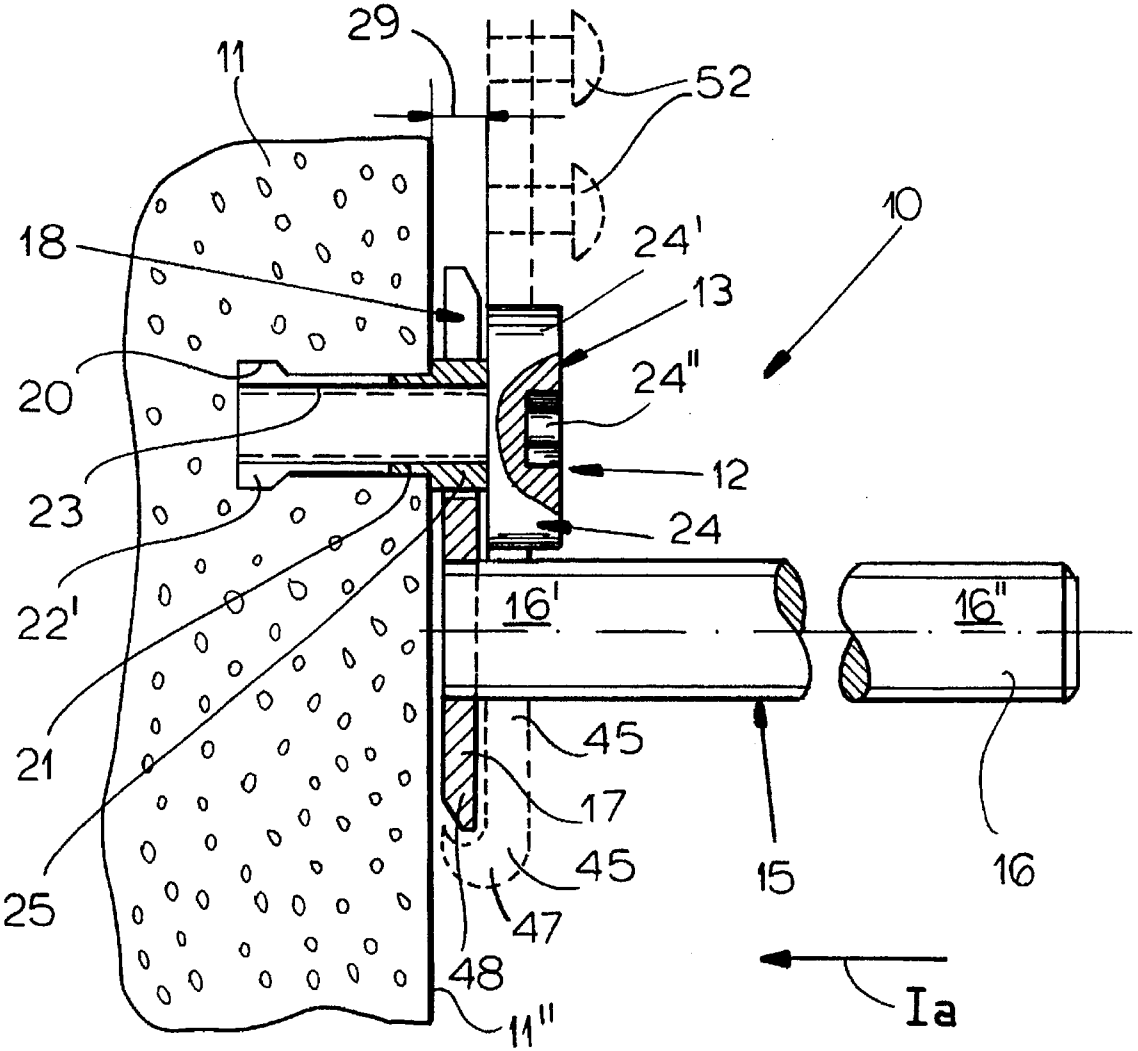
Figure 2:
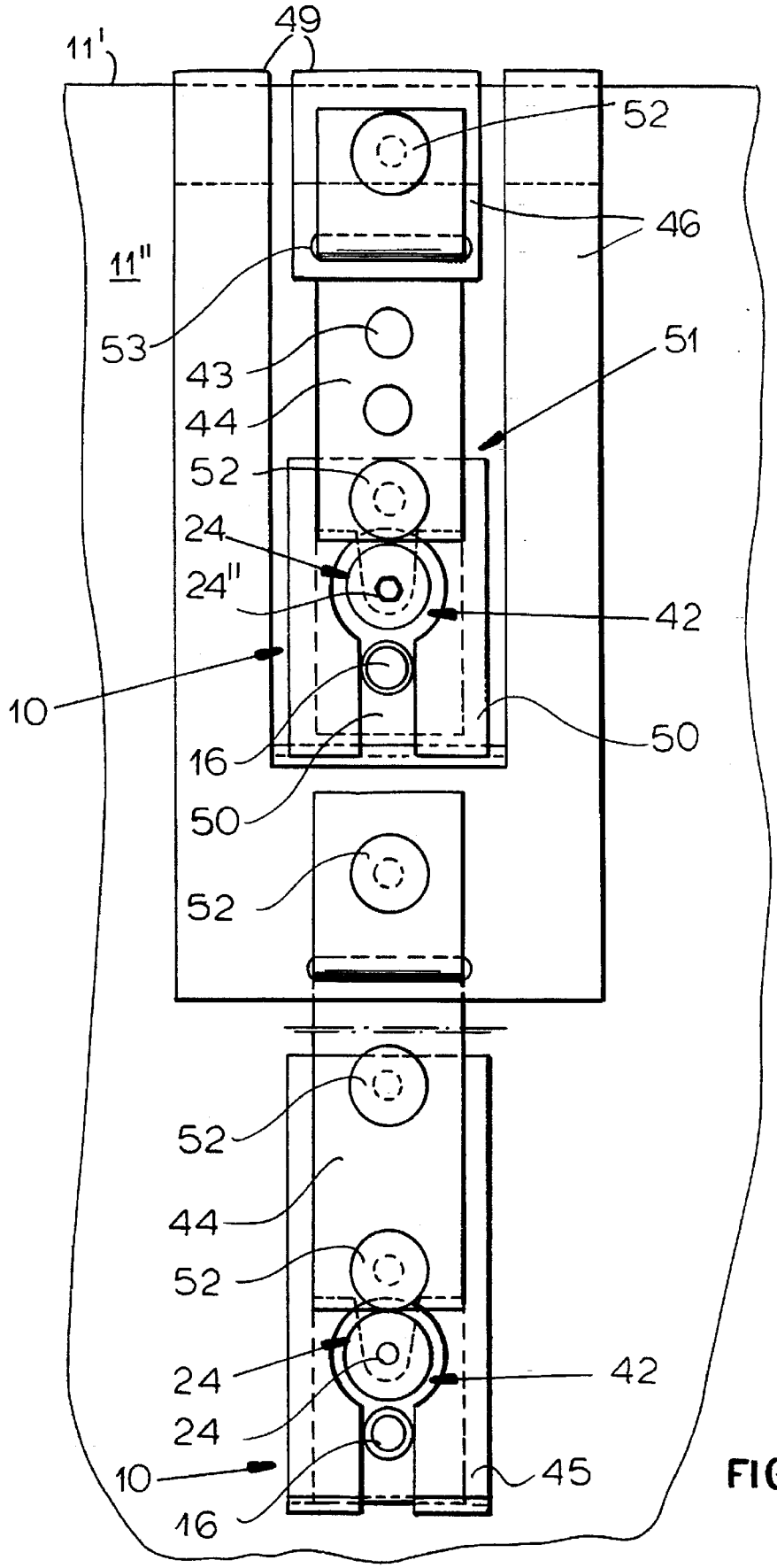
Figure 3:
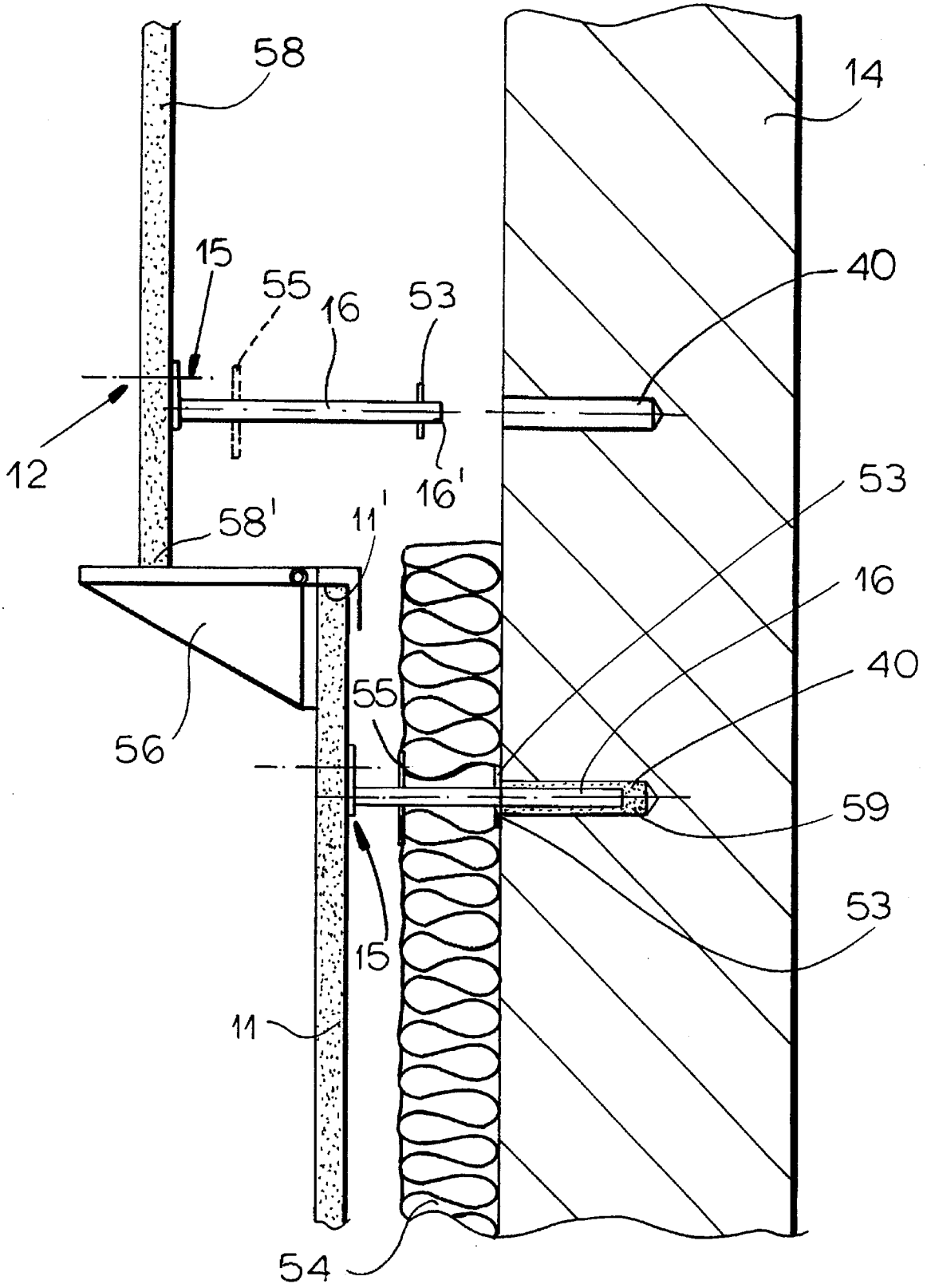
Figure 4A:
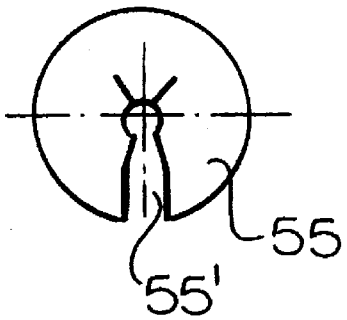
Figure 4B:
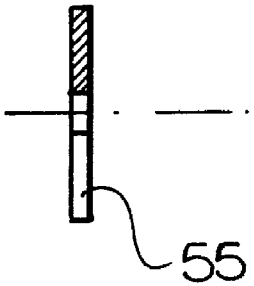
Figure 5A:
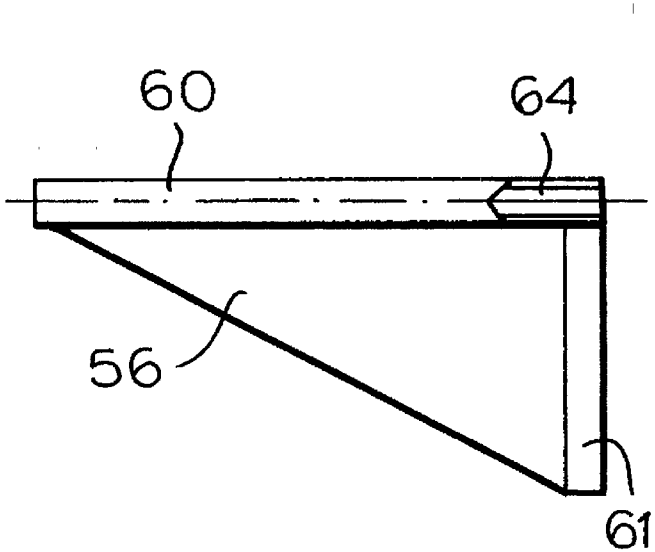
Figure 5B:
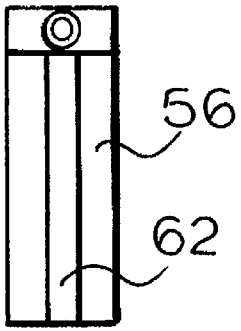
Figure 6A:
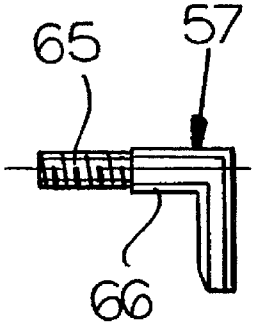
Figure 6B:
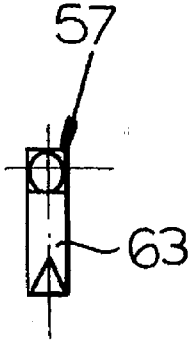
Figure 7:
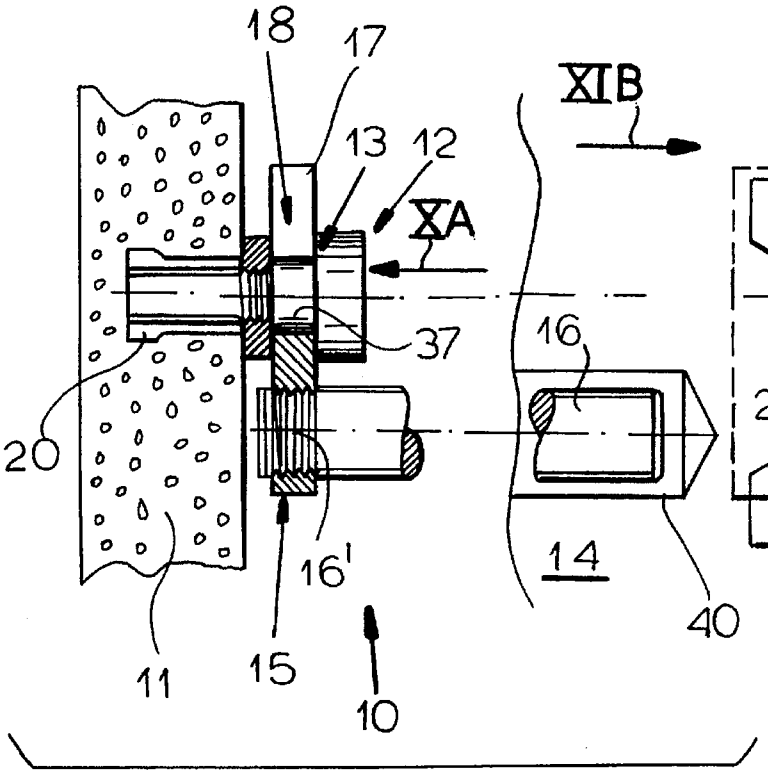
Figure 8D:
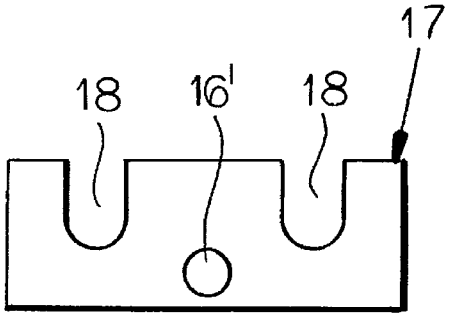
Figure 8E:
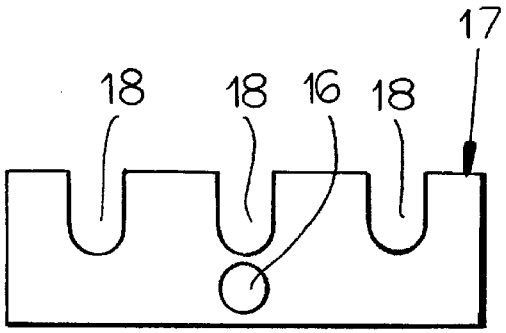
Figure 8A:
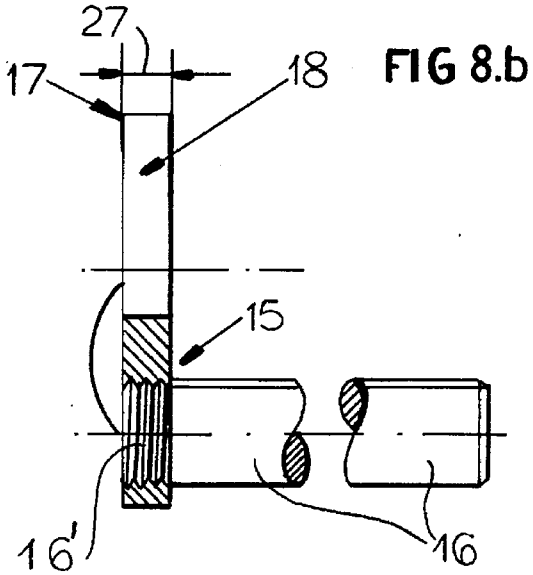
Figure 8A:
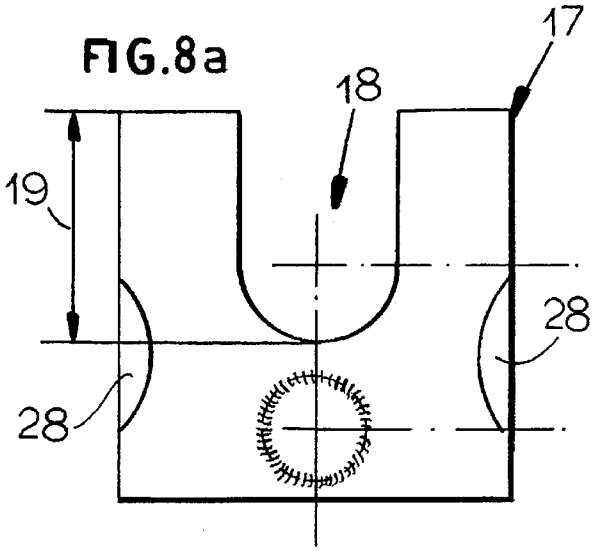
Figure 8C:
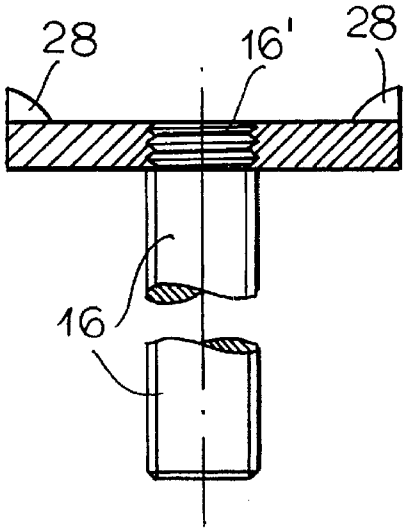

The invention is further explained with the aid of the drawing representing embodiment examples. It shows:

FIG. 1 a vertical section in the area of a connection spot of a facing panel with a wall FIG. 1*a* a view of a wall anchor in the direction A of FIG. 1, FIG. 2 a modified view of the plate rear in the direction A of FIG. 1, FIG. 3 a schematic lateral view of facing panels to be arranged over each other for covering a wall portion, FIG. 4 a lateral view and a section of an insulation layer holding plate, FIG. 5 a lateral view and an edge view of an auxiliary mounting rail, FIG. 6 a holding hook for the auxiliary mounting rail of FIG. 5 in two views, FIG. 7 a vertical section in the area of a connection spot of a facing plate with a wall, FIG. 8*a* is an elevational view of the walk anchor of FIG. 7;

FIG. 8*b* is a lateral section of the wall anchor of FIG. 7;

FIG. 8*c* is a transverse section of the wall anchor of FIG. 7;

FIG. 8*d* is an elevational view of a modified wall anchor of FIGS. 8*a*–8*c* in detail;

FIG. 8*e* is another elevational view of a modification of the wall anchor of FIGS. 8*a*–8*c*.

Figure 11:
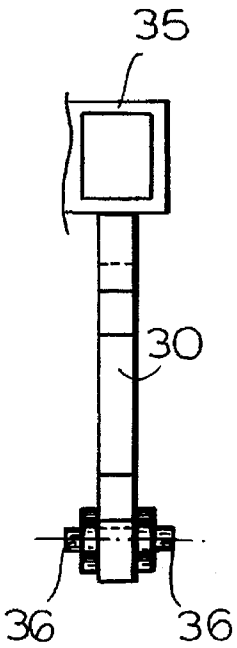
Figure 10:
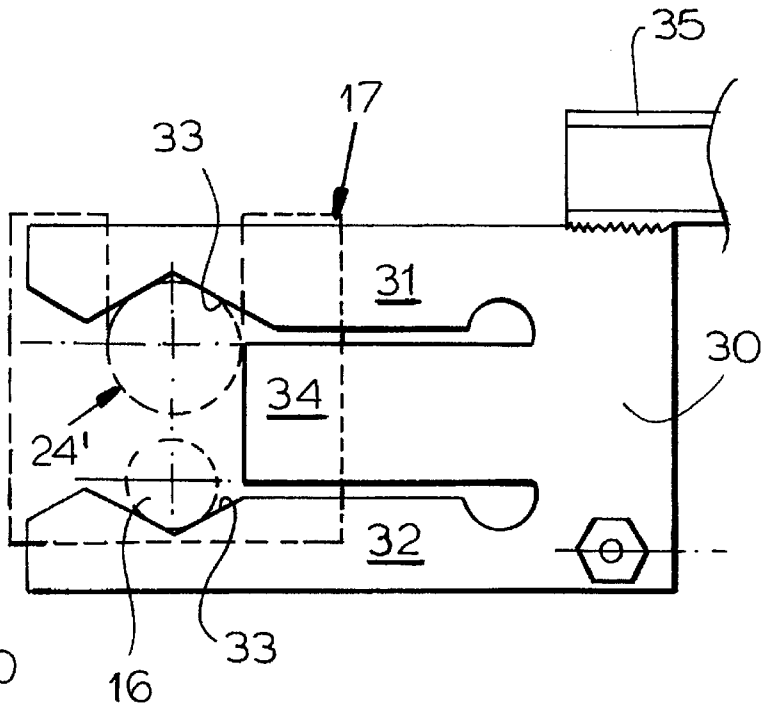
Figure 9A:
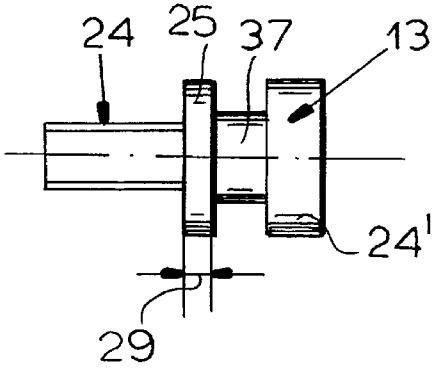
Figure 9:
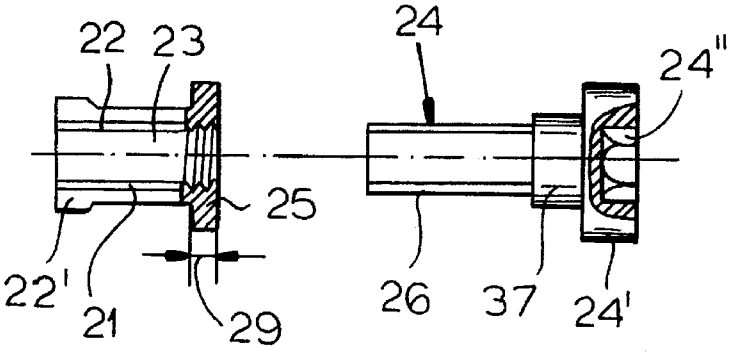
Figure 12:
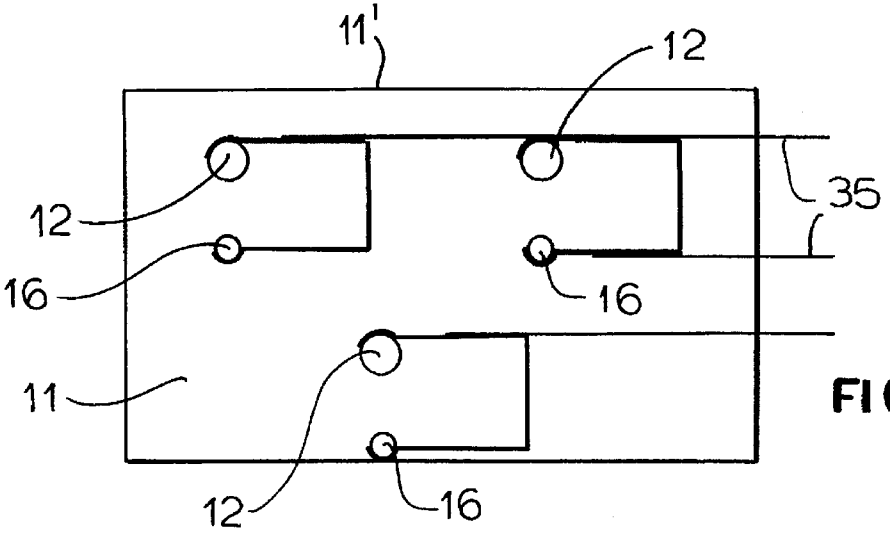
Figures 13A, 13B, 13C, 14A, 14B, 14C:
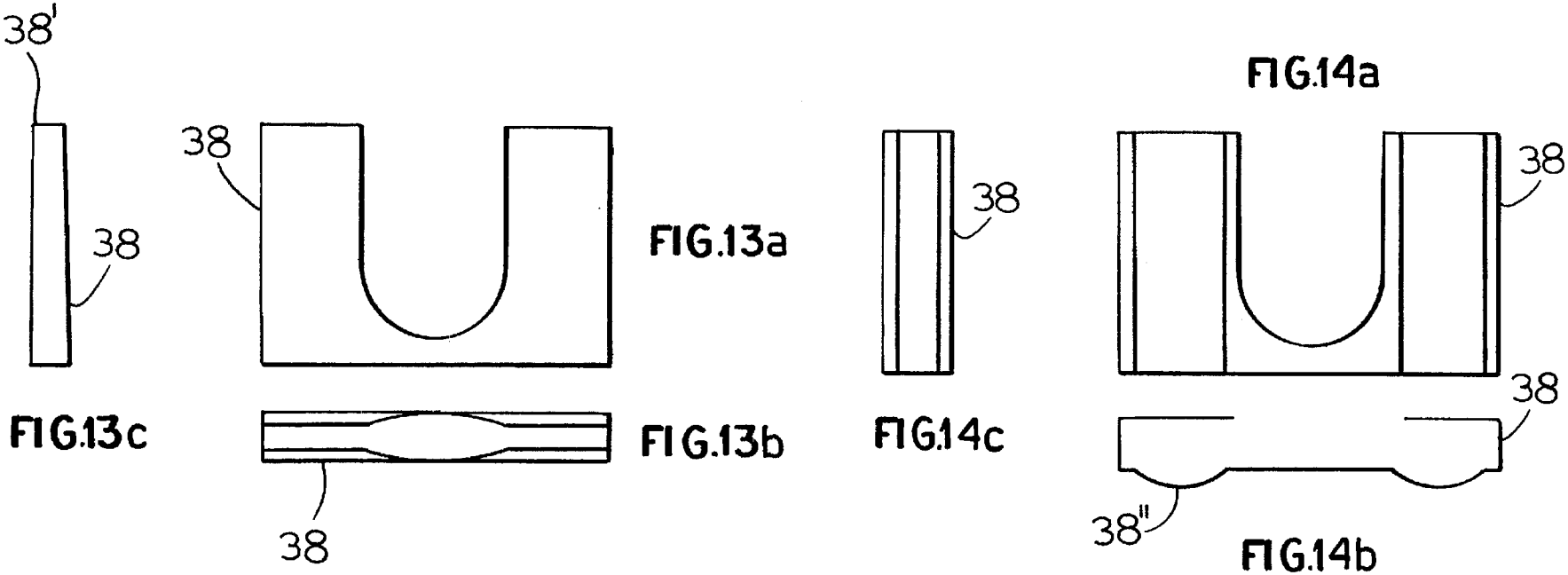
Figure 16:
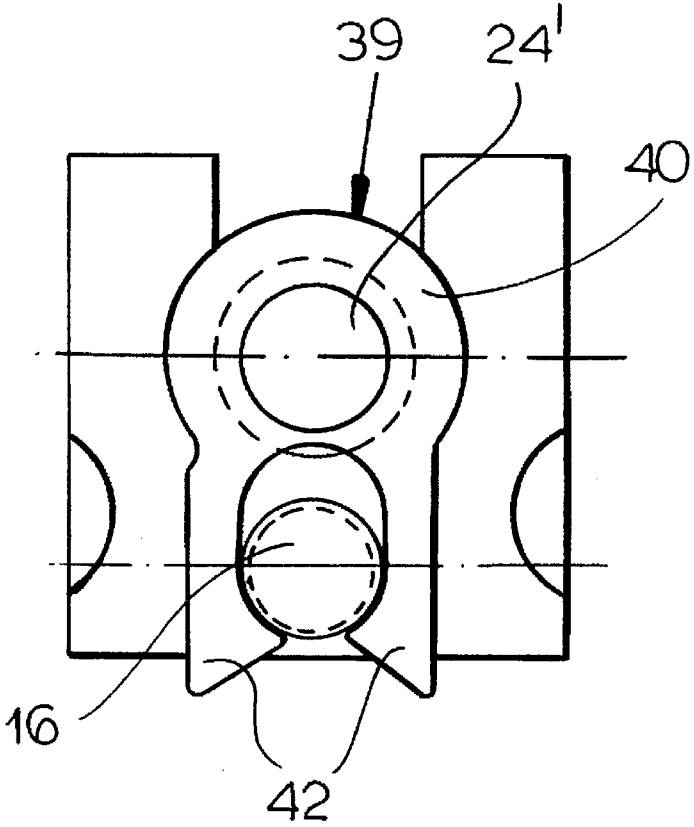
Figure 15:
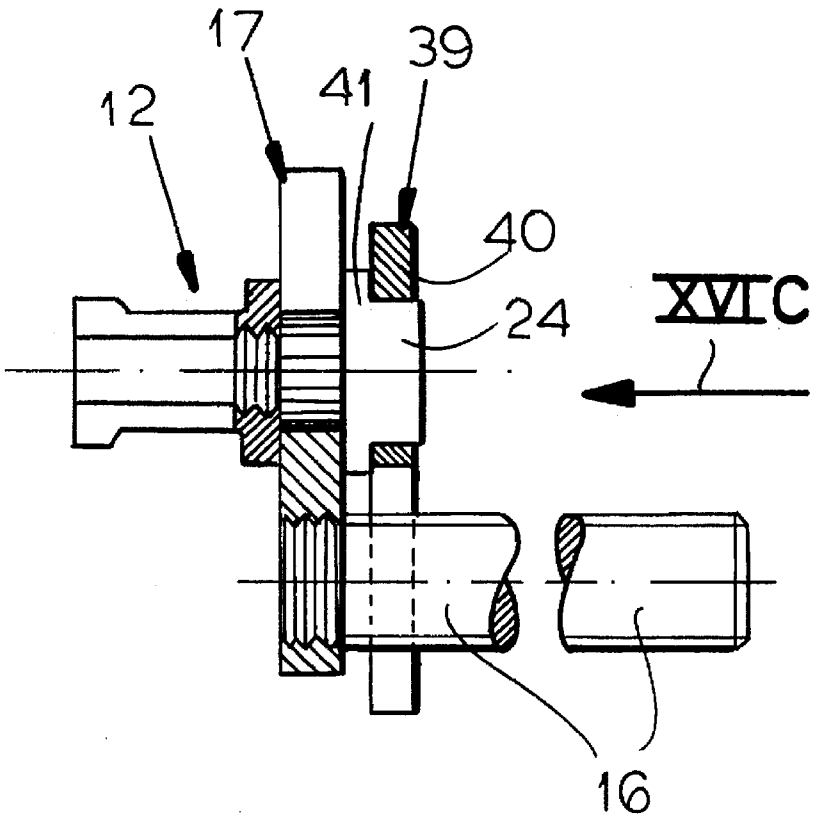

FIG. 9 a two-part securing bolt,

FIG. 9*a* a securing bolt modified with respect to FIG. 9,

FIG. 10 a schematic side view of a holding clamp holding together a wall anchor and a securing bolt in the direction A of FIG. 7, FIG. 11 a side view of the holding clamp of FIG. 10 in the direction B of FIG. 10, FIG. 12 a schematic representation of a rear view of a facing panel with three securing bolts distributed over the surface of the plate and holding clamps fastened thereto, FIGS. 13, 14 each showing different play-bridging clamping springs in three different viewing positions, FIG. 15 a representation similar to FIG. 7 for illustrating a special clamping element holding together the securing bolt and the wall anchor, and FIG. 16 a view of the clamping element on the connection spot of FIG. 9 in the direction C.

A facing panel 11 shown in FIG. 1 in partial section is to be securely connected to a wall 14 shown in FIG. 3 at several spots. For instance there are three connection spots distributed over the facing panel 11, namely two close to the lower longitudinal edge in the proximity of the lateral edges and one merely for clarification purposes above a lower connection point close to the upper longitudinal edge 11. Corresponding to this distribution of the connection spots, three bores have to be drilled in the wall, whose placement depends on the respectively used mounting 10.

Each mounting consists basically of a securing bolt 12 assigned to the facing panel 11 and a wall anchor 15 basically assigned to the wall 14. In order to connect the securing bolt 12 with the facing panel 11, the latter is provided for each connection spot with an undercut bore 20 not traversing the facing panel 11, so that the visible side of the facing panel is not visually influenced by the connection spots and particularly by the securing bolts 12. In the bore 20 a socket 21 is inserted, which is basically like a sleeve and has a coaxial threaded bore 23. Its end on the bore side is longitudinally slotted, so that corresponding spreading flaps are created which bear radial projections 22 at their ends facing the bore bottom, which can engage in the not marked undercutting of bore 20, since they have the corresponding configuration. When the socket 21 is inserted in the bore 20, the spreading flaps are at first pressed together so much that they do not hinder the introduction of the socket 21 in the bore 20. After that the spreading flaps are pushed apart by threading a socket-locking screw 24 into the threaded bore 23, until the spreading flaps of the socket 21 assume the position which can be seen from FIG. 1, wherein its projections 22 fill up the undercutting of bore 20. The spreading flaps are maintained in this position by the socket-locking screw 24, so that an extraction of the socket within the framework of the predetermined extraction forces is impossible. The socket-locking screw 24 has a screw head 24', whose outer circumference is circular and has a hexagon socket screw key 24" which is concentric with the screw axis and serve for turning the screw. In order to facilitate the accurate positioning of the socket 21, the latter is provided with an annular collar 25. The annular collar 25 is suitable shaped like a hexagon, in order to be able to securely hold the socket while the socket-locking screw 24 is screwed in. The socket-locking screw 24 of FIG. 9*a* has a corresponding annular collar 25. The annular collar 25 of this screw does not have to be shaped like a hexagon. This annular collar 25 can act instead of the annular collar 25 of the socket 21. Both annular collars have a thickness 29, which determines the distance of the wall anchor 15 from the surface of the facing panel 11 facing the wall.

The socket-locking screws 24 of the FIGS. 9, 9*a* have a head 24', whose outer circumference is circular and which has an inner hexagonal recess 24" concentric with the screw axis for turning the screw. Right under the screw head 24' follows a spacing collar 37 reaching to the threading 26, which in both cases insures that between the head 24' and the annular collar 25 a clearance remains for receiving a part of the wall anchor 15. The outer diameters of the annular collar 25 and of the screw head 24' of the socket-locking screw 24 of FIG. 9*a* are equal.

A panel-parallel anchor hook 17 of the wall anchor 15 comes to engage between the screw head 24' and panel backside 11" facing the wall. This wall anchor 15 consists basically of this panel-parallel anchor hook 17 and an anchor bolt 16. The anchor hook 17 is a flat plate with a suspension slot 18, whose width is suited to the diameter of the annular collar 25, respectively of the spacing collar 37. The anchor bolt 16 is fastened at a right angle to the panel-parallel anchor hook 17, e.g. through welding. While the plate-side end 16' of the anchor bolt 16 serves for the connection with the anchor hook 17, the other end 16" of the anchor bolt 16 is inserted in a bore 40 of the wall 14 and is there fastened for instance by cementing, see FIG. 3. For this purpose the anchor bolt 16 is provided with a thread, which insures the required resistance against extraction of the anchor bolt 16 from the wall 14. In order to insure that the anchor bolt 16 assumes precisely the position shown in FIGS. 1 and 7, the plate of the anchor hook 17 has to be parallel with the facing panel 11. Particularly it is not permitted that the anchor hook 17 be swung about the vertical axis shown in the drawing plane. This is insured by means of spacing projections 28, which according to FIG. 8 are arranged at the same distance from the axis of the anchor bolt and can rest against the rear side of the panel. Correspondingly the projection is equal to the thickness 29 of the annular collar 25 of the securing bolt 12. If according a screw according to FIG. 9*a* is used together with a socket having an annular collar 25, then the double width 29 determines the distance between the panel-parallel anchor hook 17, respectively the wall anchor 15 and the rear side of the panel 11. Correspondingly the projection extent of the spacing projections 28 has to be bigger.

The thickness of the anchor hook 17 is selected so that it engages with a slight axial play between the head 24' of the socket-locking screw 24 and the rear side 11" of the facing panel 11, whereby the play is selected so that an easy handling is possible, namely during the assembly of the wall anchor 15 with the securing bolt 12, as well as during the disassembly of these two components after the anchor bolt 15 has been secured in the wall 14. When this play is not desired, the anchor hook can be equipped with play-bridging clamping springs 38, which are shown in FIGS. 13, 14. FIG. 13 shows a clamping spring 38 which can be stuck onto the forked projections of the anchor hook 17, so that their conical point 38' engages between the annular collar 25 and the securing collar 13. When the anchor hook provided with a clamping spring according to FIG. 13 is assembled with securing bolt 12, the conical clamping spring opens in a play-bridging manner, just like the clamping spring 38 of FIG. 14, which has bulged projections 38" for bridging the play. In this case a suspension play no longer exists.

In FIG. 1*a* the suspension slot 18 can be seen, by means of which the panel-parallel anchor hook 17 surrounds the hexagonally shaped annular collar 25. The play of the suspension slot 18 is selected so that the angular position, respectively the rotated position of the annular collar 25 in the panel 11 can be any desired position. From the socket-locking screw 24 only one outline 24'" of the outer circumference of the screw head 24' is reproduced.

FIG. 2 shows a view of the rear side 11" of a facing panel 11 and two securing spots 42 distributed over the facing panel, where a top view of screw head 24' with the inner hexagonal recess 24" is shown, as well as in each an anchor bolt 16. Further two auxiliary mounting means are shown, each of them consisting of two hooks 45, 46 and a spring element 44 connecting both.

The hook 45 in the area of one of the securing spots 42 is a plate made of sheet metal with a bent up lower edge 47.

This grips the lower edge 48 of the plate-shaped anchor hook 17. The lower edge 48 is slanted, so that the lower edge 47 of the hook 45 can securely engage therein, even when the anchor plate rests snugly against the rear side 11" of the panel. In the hook 45 a slot 50 is provided, which creates a play in the area of the hook 45 for embracing the anchor bolt 16 and the securing collar 13. As a result, according to FIG. 1, the hook 45 can embrace the head 24' of the locking screw 24, functioning here as the securing collar 13, as well as the anchor bolt 16, whereby consequently it does not add on in its axial direction.

The hook 46 of the upper securing location arranged on the panel edge 11' surrounds the panel edge 11' in a manner similar to the lower edge 47 of the hook 45 which surrounds the lower edge 48 of the anchor hook 17. It rests with its essential surface against the rear 11" of the facing panel 11.

Both hooks 45 and 46 have securing elements 52, which have the configuration of mushroom-shaped arresting projections. In combination with the spring element designed like a perforated rubber band they serve for the mechanical connection of all three components. The perforated rubber band is buttoned over an arresting projection with each one of its holes 43 and therefore can not be unintentionally removed from the hooks 45, 46. For securing this connection a slot 53 is provided on hook 46 close to the edge facing the other hook 45, through which the perforated rubber band is passed from the panel rear side 11". This serves for supplementary insurance.

The hook 45 of the lower securing spot 42 is provided with two securing elements 52 arranged one over the other, so that the hook 46 is kept correspondingly straight by the spring element 44, which facilitates its handling in the area of this lower securing spot 42.

Due to the two aligned securing spots 42 the size of hook 46 for the lower securing spot 42 is selected so that it can have a recess 51 by means of which it can surround the entire auxiliary mounting means of the upper securing spot 42, so that it can lie just as flat against the rear side 11" of the facing panel 11 as the hook 46 of the auxiliary mounting means for the upper securing spot 42. In both cases the hooks 46 surround the plate edge 11' with a metal sheet edge 49 similar to the lower edge 47 of the hook 45.

The aforedescribed auxiliary mounting means is used so that at first the hook 46 is assembled with the wall anchor 15, after the latter has been coupled with the securing bolt 12 through the suspension slot 18 and the securing collar 13. After that the perforated rubber band is pulled tight and the upper hook 45 is pushed with its sheet metal edge 49 over the edge of panel 11. The elasticity of the perforated rubber band pulls both hooks 45, 46 towards each other, thereby insuring the stability of the connection between the securing bolt 12 and the wall anchor 15. The stretchability and the spacing between the holes are so mutually adjusted that on the one hand a secure fit is achieved and on the other various panel thicknesses can be accommodated. It has been found that with such auxiliary mounting means a considerably higher laying efficiency can be achieved, when compared to the known mountings for facing panels.

In FIG. 3 at the bottom a facing panel 11 fastened to a wall 14 is shown. From the for instance three anchor bolts 16 provided for the mounting of the panel, one is shown close to the upper panel edge 11'. The fastening of the anchor bolt 16 in the pertaining bore 40 is done by cementing, for which purpose a usual cementable anchor is used, whose cement mass 59 fills the space between the anchor bolt 16 and the wall of bore 40. Since it is not possible to achieve an accurate dosage of the cement mass, e.g. due to differences in the insertion depth of the anchor bolt 16, the cement mass is generously apportioned and has to be pushed out from the bore 40 by the penetrating anchor bolt 16. On the other hand care has to be taken that no hollow spaces remain. Therefore the anchor bolt 16 is provided with an elastic cover plate 53, which sits on the end 16" of the anchor bolt 16 which is not yet inserted and which rests against the wall 14 when the bolt is inserted in the bore 40. Some outflowing cement can pass the cover plate 53 due to its elasticity. On the other hand the cover plate 53 can be sufficiently rigid to insure a complete filling of the bore 40 between the bore wall and the anchor bolt 16.

Between the facing panel 11 and the wall 14 a heat-insulating layer 54 is arranged on the wall and has to be fastened thereto. For this purpose the known fastening elements can be used. FIG. 3 shows that there is an additional possibility reducing optionally even to zero the number of the traditional fastening elements, namely in that an insulating-layer holding plate 55 is slipped over the anchor bolt 16 as shown in FIG. 4, this plate being provided with a slot 55'. This plate 55 is secured in axial direction due to the design of the anchor bolt 16 as a threaded bolt and can thereby press the heat-insulating layer 54 against the wall. The arrangement of the heat-insulating layer 54 on the wall is done so that slits are cut into heat-insulating layer, so that the latter can be slipped on the wall anchor 15 when the facing panel 11 is removed. After that there is no problem in mounting the heat-insulating holding plate 55.

In order to insure that a further facing panel 58 can be arranged above the facing panel 11 simply and quickly in the correct position shown in FIG. 3, auxiliary mounting rails 56 according to FIG. 5 are used. The facing panel 58 is completed in the area of its securing bolts 12 with wall anchors 15, whereby both are held together by the auxiliary mounting means shown in FIGS. 1, 2. Correspondingly the auxiliary mounting rail 56 serves for guiding the facing panel 58 at its lower edge when the facing panel 58 is inserted with its anchor 16 into the bore 40. As a result the mounting of the facing panel 58 on the wall 14 is facilitated due to the alignment achieved with the auxiliary mounting rail with respect to the upper panel edge of the lower facing panel 11. Seen from the apparent side of the facing panel 11 the auxiliary mounting rail 56 consists of a projecting angle whose both angle sides 60, 61 are connected by a reinforcement plate 62. Suitably the thickness of the angle flank 60 is equal to the gap width between the two panels 11, 58. As a result with the assistance of the auxiliary mounting rail 56 the facing panel 58 is pushed in the correct position with respect to the facing panel 11, wherein it aligns itself with the facing panel 11. Thereby only the vertical alignment in the illustration plane has to be controlled, when the facing panel 11 is provided with two horizontal auxiliary mounting rails 56 arranged in succession.

The auxiliary mounting rail 56 is provided with a holding hook 57, which engages behind the facing panel 11 with the hook flank 63. The size of the holding hook 57 is selected so that its horizontal hook flank 67 respectively screwed into the auxiliary mounting rail 56 has a thickness corresponding to the desired distance between panels, and that the vertical hook flank 61 of the auxiliary mounting rail 56 rests snugly at the apparent side of the facing panel 11. As a result of this arrangement it is necessary to take into account the thickness of the panel 11 when the auxiliary mounting rail 56 is used. Therefore the holding hook 57 can be a part separate from the auxiliary mounting rail 56. Both parts are connected to each other by threading, wherefor the auxiliary mounting rail 56 has a bore 64 and the holding hook 57 has a threaded pin 65. The latter can be screwed into the bore 64 to a depth corresponding to the thickness of the facing panel 11. In order to make sure that no unintentional change of this position can occur, an arresting screw not shown in the drawing is provided, which is screwed into the auxiliary mounting rail 56 and thereby presses transversely on the holding hook 57.

The auxiliary mounting rail 56 has to be removed, which happens either after the anchor bolt 16 of the wall anchor is securely fitted into the wall 14, or by introducing spacing means, e.g. spacing blocks, into the panel gap defined by the auxiliary mounting rail 56. This rail 56 is then rotated by 90° with respect to the illustration plane in FIG. 3, so that the hook 57 can be extracted also with its flank 63. The flank 53 is correspondingly flattened.

In FIG. 10 the contour of a panel-parallel anchor hook 17 is shown in broken lines. The head 24' of the socket-locking screw and the diameter of the anchor bolt 16 are also shown in broken lines. The securing bolt 12 and the wall anchor 15 are pressed together by a spring-loaded holding clamp, respectively clamped together, by providing a U-shaped spring-loaded holding clamp 30, which has two arms 31, 32. The arm 31 is arranged above the head 24' of the socket-locking screw 24, while the arm 32 engages underneath the anchor bolt 16. As a result of the spring effect of the holding clamp 30 the securing bolt 12 and the wall anchor 15 are pressed together as much as possible, whereby the base of the suspension slot 18 rests against the spacing collar 37. In order to secure the position of the holding clamp 30, the edges of arms 31, 32 have recesses 33 which are fitted to the rounding of the head 24 of the anchor bolt 16. Further an insertion stop 34 is provided, which pushes against the head 24 when the holding clamp 30 is pushed into the shown position.

The holding clamp 30 is used in such a manner that a facing panel 11 according to FIG. 12 is placed with its apparent side on a mounting surface. After that the sockets 21 are inserted and the socket-locking screws 24 are screwed in. Then the wall anchors 15 with their anchor bolts 16 are brought in their position shown in FIG. 7, so that the holding clamps 30 can be slid on from the right to the left as in FIG. 12. All connection pieces are at this point on the rear side of the facing panel 11. After the bores 40 are made in the wall 14, whereby the drilling patterns for the bores 20 of the facing panel 11 was used also for the bores 40 of the wall 14 and after cement has been introduced in the bores 40, the facing panel 11 can be mounted to the wall 14 with the thereto attached holding clamps 30, whereby the holding clamps 30 remain in place until the cement has hardened. After that the holding clamps 30 are pulled off the screw heads 24' and the anchor bolts 16. For this purpose serves a handle 35 which protrudes laterally beyond the surface of the facing plate 11 and allows for the holding clamps 30 to be pulled off. According to FIG. 11 each handle 35 consists of a hollow section, whose dimensions are selected so that it fits into the space between the facing panel 11 and the wall 14. In order to keep the clamp 30 in a vertical position in this space, the holding clamp is provided with spacing projections 36, which for instance can consist of a threaded pin stuck through the clamp 30 with locknuts at both ends. From FIGS. 10 to 12 it can be seen that the handles 35 are affixed to the longitudinal edges of the holding clamps 30. Therefore by turning the clamps 30 about the axis lying horizontally in the drawing plane it becomes possible to provide also two horizontally aligned connection spots with holding clamps 30, without their handles 35 interfering with each other.

The FIGS. 15, 16 show a clamping part 39, which also serves for holding together the wall anchor 15 and the securing bolt 12 prior to the fastening of the facing panel 11 to the wall 14. For this purpose the clamping part 39 is provided with an annular body 40, which is slid over and/or fastened on the head 24' of the socket-locking screw 24. An annular collar 41 of the socket-locking screw 24 holds the clamping part 39 at a distance from the anchor hook 17 of the wall anchor 15. On the annular part 40 of the clamping part 39 parallel projecting arresting flanks 42 are provided, which clamp about the anchor bolt 16 in an arresting manner. In this case also the anchor bolt 16 and therewith the entire wall anchor 15 are pulled as snugly as possible against securing bolt 12, thereby insuring the relative position of the two connecting components 12, 15 at all connection spots between the facing panel 11 and the wall 14.

I claim:

1. Mounting (10) comprising facing panels (11) which have several securing bolts (12) with panel-parallel securing collars (13) projecting from an inner side of the panel, behind which engages at least one hook-like wall anchor (15) which is able to be anchored to a wall (14) by an anchor bolt (16) and which receives the securing bolts (12) in suspension slots (18), whereby a detachable auxiliary mounting means is provided, characterized in that the detachable auxiliary mounting means comprising a spring element between the securing bolt (12) and the wall anchor (15), which pulls the wall anchor (15) towards the securing bolt (12) and is fastened to one edge of the panel (11').

2. Mounting according to claim 1, characterized in that the spring element (44) engages behind the wall anchor (15) with an inherently rigid hook (45) and with a further inherently rigid hook (46) engages behind the panel edge (11'), wherein the hook (45) engaging behind the wall anchor (15) is a plate with a bent up lower edge (47) for a plate-shaped anchor hook (17) with a slanted lower edge (48) and the hook (46) engaging behind the panel edge (11') is a metal sheet plate with a metal sheet edge (49) reaching around the panel edge (11').

3. Mounting according to claim 2, characterized in that the hook (45) engaging behind the wall anchor (15) has an open slot (50) in the area of a hook edge for embracing the anchor bolt (16) and the securing collar (13) with play and the hook (46) engaging behind the panel edge (11') has a recess (51) for embracing a mounting (10) close to the panel edge.

4. Mounting according to claim 3, characterized in that the hooks (45, 46) engaging behind the wall anchor (15) and the panel edge (11') respectively have fastening elements (52) for the spring element (44) and the spring element (44) is a perforated rubber band which is buttoned with holes (43) over at least one fastening element (52) designed as an arresting projection of one of the engaging hooks (45, 46).

5. Mountings according to claim 1, characterized in that the securing bolt (12) has a socket (21) arranged in the facing panel (11) with a radially projecting annular collar (25), as well as a socket-locking screw (24) with a head (24') radially projecting over the annular collar (25), forming the panel-parallel securing collar (13), and that the annular collar (25) of the socket (21) is suspended in a suspension slot (18) of a panel-parallel anchor hook (17).

6. Mounting according to claim 1, characterized in that the anchor bolt (16) is provided close to its wall-side end (16") with an elastic closing plate (53) which is longitudinally slidable on the bolt (16) during its insertion in a bore (40) and that the anchor bolt (16) is provided with an insulating-layer holding plate (55) which is able to be transversely fitted between the wall (14) and the facing panel (11) after the heat-insulating layer (54) has been fastened.

7. Mounting according to claim 1, characterized in that over the panel edge (11') of the facing panel (11) fastened to the wall (14) at least one auxiliary mounting rail (56) projecting from an outer side of the panel is detachably hooked, whose holder (57), following the mounting of a further facing panel (58), can be pulled out of a the gap between the two facing panels (11, 58) after it was rotated by 90°.

8. Mounting according to claim 7, characterized in that the holding hook (57) is connected with the auxiliary mounting rail (56) so that it is able to be adjusted by a screw and is able to be locked by an arresting screw in various positions and the auxiliary mounting rail (56) is able to be removed after support means have been introduced in the gap between the two facing panels (11, 58).

9. Mounting according to claim 1, characterized in that the wall anchor (15) has the anchor bolt (16) parallel to the securing bolt, whose panel-side end (16') has a panel-parallel anchor hook (17), and the panel-parallel anchor hook (17) comprises of a flat plate which is welded to the anchor bolt (16) which is designed as a threaded bolt.

10. Mounting according to claim 9, characterized in that a panel-parallel anchor hook (17) has a vertical suspension slot (18) open at the top, whose suspension length (19) is bigger than the gap width between two facing panels or the panel-parallel anchor hook (17) has several mutually parallel suspension slots (18) each accommodating one securing bolt (12).

11. Mounting according to claim 10, characterized in that the securing bolt (12) has a socket (21) arranged in the facing panel (11) with a socket-locking screw (24), wherein the socket-locking screw (24) has a spacing collar (37) between its head (24') and the thread (26), which in the mounted position rests directly or via an annular collar (25) on the socket (21), the height of the spacing collar being slightly bigger than the plate thickness (27) of the anchor hook and the anchor hook (17) is provided on a panel side with spacing projections (28), whose projection extent equals the thickness (29) of the annular collar (25) of the socket (21) the socket-locking screw (24).

12. Mounting according to claim 1, characterized in that a U-shaped spring-loaded holding clamp (30) is provided, for the purpose of holding together the wall anchor (15) with a facing panel (11) prior to the fastening of the facing panel (11) to a wall (14), which is clamped with one arm (32) over the securing bolt (12) and with the other arm (32) underneath the wall anchor (15).

13. Mounting according to claim 12, characterized in that the holding clamp (30) has arresting recesses (33) and/or insertion stops (34) on the arm edges facing each other.

14. Mounting according to claim 12, characterized in that the holding clamp (30) is provided with a handle (35) having the same length as the panel or with spacers (36).

15. Mounting according to claim 1, characterized in that for holding together the wall anchor (15) with the facing panel (11) prior to the fastening of the facing panel (11) to a wall (14), over or fastened on the head (24') of a socket-locking screw (24), a clamping part (39) is slid, which grips around the anchor bolt (16) in an arresting manner.

16. Mounting according to claim 15, characterized in that the clamping part (39) is provided with a handle (35) having that same length as the panel or with spacers (36).

17. Mounting according to claim 1, characterized in that the anchor hook (17) or the securing collar (13) have a conical play-bridging clamping spring (38) which eliminates the suspension play transversely to the facing panel (11).

* * * * *